United States Patent [19]

Nimz et al.

[11] Patent Number: 5,074,960

[45] Date of Patent: Dec. 24, 1991

[54] LIGNIN REMOVAL METHOD USING OZONE AND ACETIC ACID

[75] Inventors: Horst H. Nimz; Alex Berg, both of Hamburg, Fed. Rep. of Germany

[73] Assignee: Acetocell GmbH & Co. KG, Fed. Rep. of Germany

[21] Appl. No.: 606,595

[22] Filed: Oct. 31, 1990

Related U.S. Application Data

[63] Continuation-in-part of Ser. No. 300,843, Jan. 24, 1989, abandoned.

[30] Foreign Application Priority Data

Jan. 25, 1988 [EP] European Pat. Off. ..... 88810034

[51] Int. Cl.[5] ..... D21C 9/153

[52] U.S. Cl. ..... 162/65; 162/76

[58] Field of Search ..... 162/65, 65 B, 75, 76, 162/19

[56] References Cited

U.S. PATENT DOCUMENTS

| | | | |
|---|---|---|---|
| 3,553,076 | 1/1971 | Haas et al. | 162/76 |
| 4,119,486 | 10/1978 | Eckert | 162/65 |
| 4,372,812 | 2/1983 | Phillips et al. | 162/65 |

FOREIGN PATENT DOCUMENTS

| | | | |
|---|---|---|---|
| 3110822 | 10/1982 | Fed. Rep. of Germany | 162/65 |
| 3445132 | 6/1986 | Fed. Rep. of Germany . | |
| 2353674 | 12/1977 | France . | |

OTHER PUBLICATIONS

Chemical Abstracts 38887c vol. 103, No. 6, 8-12-85.
Abstract Bulletin of Institute of Paper Chemistry, vol. 53, No. 3, 2966, 9-82; vol. 47, No. 6, 6669,12-76;vol. 53, No. 8, 8417, 2-83; vol. 54, No. 6, 6233, 12-83; vol. 55, No. 8; 8883, 2-85.
Mbachv et al., Tappi, vol. 64, pp. 67-70, Jan. 1981.

*Primary Examiner*—Karen M. Hastings
*Attorney, Agent, or Firm*—Wigman & Cohen

[57] ABSTRACT

Lignin contained in a cellulosic or lignocellulosic pulp product is removed by contacting the product with a gaseous medium containing ozone in the presence of a liquid agent which is a lower fatty acid, such a formic, acetic or propionic acid, having only a low solvent capacity for lignin; as a consequence of this treatment, lignin which is present in the product will be converted into a lignin derivative that has an increased solubility in the fatty acid and can be removed quantitatively by extraction from the lignocellulosic material. Purified pulp can thus be obtained with increased processing efficiency and without most pollution problems of prior art processing methods because the fatty acid used as the main constituent of the processing liquid in all stages of pulp production can be circulated counter-currently through the stages of the process with purification of the acid for recirculation only after its use in the digestion step where the normal starting materials of pulp production, i.e. wood or annual plants, are treated according to the acetosolve process at ambient pressure and temperatures of below 120° to form a raw pulp product.

34 Claims, No Drawings

LIGNIN REMOVAL METHOD USING OZONE AND ACETIC ACID

CROSS-REFERENCE TO RELATED CASES

The present invention is a continuation-in-part application of application Ser. No. 07/300,843, filed Jan. 24, 1989, now abandoned.

BACKGROUND OF THE INVENTION (1) Field of the Invention

This invention generally relates to processing of hemicellulosic materials for producing purified cellulosic products including purified pulp and pure cellulose for industrial use. Specifically, the invention is concerned with a method of removing lignin from hemicellulosic materials in the processing thereof.

(2) Description of the Prior Art

Conventional methods of processing lignocellulosic products generally include one or more refining steps and the preferred prior art method of obtaining a product of sufficient brightness is bleaching by means of chlorine-based bleaching agents. Further, oxygen compounds, such as peroxidic or peracetic agents and ozone($O_3$) have been suggested for bleaching of cellulosic materials. Use of chlorine-based bleaching agents has met with increasing objections for ecological reasons and various attempts were made to replace chlorine bleaches in lignocellulose processing. Use of ozone as a supplemental or complemental bleaching in the paper industry has been discussed repeatedly in scientific papers, cf. Abstract Bulletin of the Institute of Paper Chemistry: Vol. 47, No. 6, page 686, abstract 6669; Vol. 53, No. 3, page 331, abstract 2966; Vol. 53, No. 8, page 916, abstract 8417; Vol. 54, No. 6, page 672, abstract 6233; Vol. 55, No. 8, page 937, abstract 8883; and Chemical Abstracts, Vol. 103, No. 6. page 88, summary 38887c.

Ozone for treating of wood is disclosed in U.S. Pat. No. 4,119,486 where the ozone is used for bleaching pulp in the form of an aqueous slurry and in the presence of specific surfactants. U.S. Pat. No. 4,372,812 teaches use of ozone in a chlorine-free bleaching method for lignocellulosic pulp where ozone bleaching stages are followed by aqueous extraction with alkaline (caustic) agents.

Published German patent application No. 3,445,132 discloses a method of preparing pulp by percolating wood at an elevated temperature and ambient pressure with a digestion liquid composed of aqueous acetic acid and a small portion (0.05% to 0.2%) of hydrochloric acid; near the end of the treatment a minor portion (0.5% to 2%) of hydrogen peroxide may be added to the percolating liquid for brightening effects so as to avoid use of chlorine bleaches. This method has since become known and accepted in the art as the "acetosolve" process.

It should be noted that conventional concepts of "bleaching" imply discoloration rather than physical removal of impurities that are present in an otherwise uncolored or "bright" base material. The present invention, on the other hand, is concerned with actual removal of a substance, i.e. lignin, in the course of processing lignocellulosic materials, and the use of ozone as a bleaching agent should be distinguished from its use as a reactant for selective modification of certain properties of the lignin contained as a component in a lignocellulosic material In this context, the term "lignocellulose" is intended to refer to generally macromolecular substances which contain hemicellulosic materials as well as lignin in addition to cellulose.

Further, previous efforts of using ozone as a bleach in commercial pulp production have generally suffered from the fact that ozone in the slurry water present in bleaching steps according to the art reacts with hydroxyl ions to form hydroxyl radicals which, in turn, cause degradation of the cellulose molecules and hence a deterioration of the strength properties of the pulp fibers. Such deterioration effects have, in fact, promoted the belief that ozone is not an advantageous bleaching means for pulp production.

On the other hand, it was found that the pulp obtained by digestion according to the acetosolve process with acetic acid/hydrochloric acid as the digestion medium may contain up to about 4% by weight of residual lignin which preferably is treated with peracetic acid formed upon addition of hydrogen peroxide to the acetic acid in which the pulp is slurried after termination of the first stage of the acetosolve process. Peracetic acid has been found to be a selective oxidizing agent for lignin, i.e. without causing oxidative deterioration of the non-lignin constitutents, notably the cellulose. On the other hand, relatively large amounts of hydrogen peroxide may be needed in the acetosolve process to achieve a satisfactory degree of lignin removal; further, a satisfactory degree of brightness is generally achieved with the hydrogen peroxide addition only when processing hardwood pulp rather than softwood pulp.

OBJECTS AND SUMMARY OF THE INVENTION

Accordingly, it is a main object of the present invention to provide for an improved method of removing lignin from a lignocellulosic material upon processing thereof, such as in production of pulp according to the acetosolve process, to provide for a substantially complete lignin removal as evidenced by an outstanding degree of product brightness even if pulp is made from softwood or softwood mixtures.

Another object is to provide for a method of using ozone in the refinement of lignocellulosic materials without causing detrimental changes of the pulp fibers.

Yet another object of the invention is to provide for economic and ecological improvements in the production of pulp and other forms of purified cellulose.

Further objects will become apparent as this specifications proceeds.

It has been found that the above objects and further advantages can be achieved according to the present invention when treating a lignocellulosic material, i.e. a cellulosic material containing lignin, for removal of the lignin from the cellulosic material by contacting the material with a gaseous medium containing ozone in the presence of a processing liquid selected from lower fatty acids (i.e. containing 1 to 3 carbon atoms) in which lignin - at processing temperatures of below 120° C.- has a very limited solubility: the ozone treatment according to the invention has been found to cause oxidative modification or conversion of the lignin with the result that the modified lignin is substantially more soluble in the lower fatty acid used as processing liquid and can be removed by extraction with such acid more easily and substantially without leaving residues of lignin or converted lignin in the cellulosic material and without oxidative deterioration of the cellulosic material as evidenced by the physical parameters of the latter.

Without wishing to be bound to any specific theory it can be assumed that the suitability of ozone in a lower fatty acid for selective removal of residual lignin from pulp is based upon a substantially higher solubility and stability of ozone in fatty acids than in water. Thus, relatively higher effective ozone concentrations can be used without increasing undesirable side reactions due to ozone decomposition. On the other hand, it can be assumed that lower fatty acids act as receptors or acceptors for any free OH radicals by reacting with them and thus preventing that these most unselective radicals attack the cellulose molecules. Ozone, on the other hand, does not itself act as a free radical but preferentially as an electrophile with the result that lignin is selectively attacked and is degraded or converted into products that have a substantially higher solubility in the processing liquid, i.e. the fatty acid, that thus will become a much more effective extracting agent for lignin removal.

Because of the increased stability of ozone in lower fatty acids its "bleaching" efficiency (i.e. insofar as product brightness per amount of ozone is concerned) is increased and, hence, ozone consumption will be reduced which is of substantial importance for its use in commercial operation. Furthermore, cellulose is less soluble in fatty acids, such as acetic acid, than in water which is another advantage when using such fatty acids as the main constituent of the processing liquid, i.e. both for digestion as well as for any subsequent extraction or refining step.

DISCUSSION OF PREFERRED EMBODIMENTS

The term "cellulosic material as used herein is intended to encompass all materials (including starting materials) which are suitable for pulp or cellulose production and contain cellulose (this includes both alpha-cellulose and hemicelluloses) and lignin.

Suitable $C_{1-3}$-fatty acids are formic acid, acetic acid and propionic acid. Acetic acid is preferred. Mixtures of such acids with one another and/or with water in limited amounts are also suitable, the amount of water in the fatty acid, in the fatty acid mixture or in the preferred acetic acid generally being less than 50% by weight, in particular less than 30% by weight and mostly being 1% to 10% by weight. A low water content of, for example, 2% to 10% by weight, i.e. a 90% to 98% acetic acid, is particularly preferred.

The ozone obtainable, for example, with conventional generators is contained in the gas phase which surrounds the mixture combined with fatty acid and consisting of, for example, 2% to 50% by weight of cellulosic material and 98% to 50% by weight of fatty acid.

The interaction between the cellulosic material and fatty acid mixture on the one hand and the gas phase or the ozone present therein on the other hand can be controlled in particular by agitation and/or the amount of ozone present and/or the temperature. Upon agitation, both the intensity of mixing and the distribution of the solid and liquid phase can be controlled and varied or adapted. Conventional mixing apparatus which is sufficiently resistant to the components can be used for this purpose; mixers having a significant shear effect on the material being mixed are, however, less preferred.

The amount of ozone present in the gas phase can be controlled by gas pressure and/or the ozone concentration in the gas phase. The procedure is preferably carried out under normal ambient pressure using a gas phase which predominantly consists of air. However, it is also possible to carry out the procedure in a gas phase consisting predominantly of oxygen, and/or under superatmospheric pressure.

The ozone concentration of a gas phase suitable herein and consisting predominantly of air or oxygen, under atmospheric or slightly superatmospheric pressure, is 0.1% to 10%, as a rule 1% to 3%. These values are based on the gas volume. Lower ozone concentrations are possible but are not preferred. Amounts of ozone of from 1% to 2% by weight, relative to the weight of the cellulosic material present can be used, although higher concentrations can also be employed without adverse effects on the pulp obtained if the procedure is carried out at the preferred temperatures of 0° C. to 30° C. In general, the working temperature (measured in the cellulosic material or in the gas phase) is below 100° C., in particular below 50° C.

The process according to the invention has particular advantages if used as a delignification stage in pulp processing where the starting material, in particular wood, is digested with acetic acid, preferably by the acetosolve process described in DB-A-3 445 132. When softwoods are used (for example, spruce wood), this has particular advantages because in this case the consumption of peroxide in the known treatment with peroxides is comparatively high.

In general, there appears to be a relationship between the lignin content (expressed as the kappa number) of a cellulosic material and the optimal use of the treatment according to the invention with ozone; optimal results are frequently obtained when the kappa number is brought to about 20 (corresponding to a lignin content of about 3%) by the digestion process (preferably also in $C_{1-3}$-fatty acid, in particular acetic acid) and is then reduced by the ozone treatment, according to the invention, in acetic acid to such an extent, for example to kappa values of less than 5, that a desired final whiteness of, typically, more than 70% ISO can be achieved by a final treatment with peracetic acid as is preferred for producing pulp of maximum brightness.

The kappa values or kappa numbers as used herein are determined by conventional methods, e.g. that described in "Merkblatt IV/37/80" of the "Fachausschuss fur chemische Zellstoff- und Papierprufung im Verein der Zellstoff- und Papierchemiker und -ingenieure" (Technical Committee for Chemical Pulp and Paper Testing in the Association of Pulp and Paper Chemists and Engineers; Federal Republic of Germany).

Whiteness or brightness in the above mentioned range can also be achieved if the treatment is carried out first with peracetic acid and then with ozone. According to the prior art, a whiteness of more than 70% ISO after the digestion with acetic acid was achieved only with relatively large amounts of peroxide. Whitenesses of more than 80% ISO can be achieved, according to the invention, if the pulp is treated in a three-stage refining process, first with ozone (Z), then with $H_2O_2$ (P) and finally again with ozone (Z), or with a PZP bleaching sequence in the same solvent, i.e. a $C_{1-3}$-fatty acid or acetic acid.

The process according to the invention is particularly advantageous as a stage in a "counter-current process", which can be carried out, for example, with known carousel extractors in accordance with the Journal "Holz als Roh- und Werkstoff" (Wood as raw material and engineering material), 44 (1986), 207–212; in a preferred embodiment of this process, acetic acid, with or without ozone, is used not only for the final extraction but as the sole lignin solvent. In this case, an operation employing low consistency, preferably 2% to 10% of pulp, and ozone concentrations of less than 2%, e.g. 0.5% to 1.5%, is preferred. Again, the acetic acid used should contain less than 50% by weight of water. Instead of water, however, another substance in particular another $C_{1-3}$-fatty acid, may be added, i.e. it is also possible to use acetic acid which contains, for example, 1% to 50% by weight of propionic and/or formic acid.

More particularly, the process according to the present invention comprises the steps: digesting said cellulosic material with an aqueous liquid comprising a major amount of $C_{1-3}$ fatty acid and obtaining a raw pulp which includes a residual amount of lignin; solubilizing the residual lignin in the pulp using gaseous ozone in concentration of from about 1% to about 3%; and recovering substantially lignin-free pulp. Additionally, the solubilized lignin is extracted from the pulp using a $C_{1-3}$ fatty acid-containing aqueous liquid. In a preferred embodiment, the steps of digesting, solubilizing and extracting the solubilized lignin are carried out by counter-currently contacting purified acetic acid aqueous solution in the extracting step, and thereafter utilizing the aqueous acetic acid liquid for the solubilizing and for the digesting steps. The acetic acid solution leaving the digester is passed to a purifier, and the purified acetic acid is again utilized in the extracting step.

In general, apparatus means suitable for carrying out the process according to the invention as a separate treatment or as a step in a sequence of treatments or processing stages in pulp production are conventional reactors which have at least one chamber or zone for holding the cellulosic material containing the fatty acid, or acetic acid, and means for treating the material with an ozone-containing gas phase. Those parts of the apparatus which come into contact with the material or the gas phase should be made of corrosion-resistant materials, preferably steel alloys.

As already indicated above, the properties, for example the characteristic values of the pulp obtained, such as breaking length, bursting area and tear resistance, are not significantly changed by the treatment with the ozone according to the invention; the process according to the invention makes it possible to obtain pulp products of a quality corresponding to that of a conventional pulp obtained by the sulfate process and which is substantially better than that of products obtained by the sulfite process.

DETAILED DISCUSSION OF PREFERRED EMBODIMENTS

The invention will be further illustrated without limitation by means of the following examples in which percentages are by weight except where indicated otherwise. Evaluation parameters and procedures are as specified by the Technical Association of the Pulp and Paper Industry (TAPPI, Atlanta, GA, USA) or in German Industrial Standards (DIN). The weight average degree of polymerization is a TAPPI standard. "ISO" refers to the whiteness standard defined by the International Organization for Standardization, Geneva, Switzerland. "SR" is the numeric value of "freeness" or "milling degree" and refers to "Scholler-Rieger Degrees" as specified in the DIN Standard; this parameter is indicative of the level of comminution. Other values are metric (ISO) standards.

EXAMPLE 1

(A) 289 g of cellulosic material in the form of spruce wood pulp moistened with acetic acid and containing about 8% by weight of lignin (50 g absolutely dry, kappa number 59) are beaten with 2 liters of 93% acetic acid in a beaker for 8 minutes with a powerful stirrer, filtered off while hot over a frit, and rinsed with hot 93% acetic acid. The pulp then has a kappa number of 24. It is rotated in a round-bottomed flask at 70° C. for 5 hours with 600 ml of 93% acetic acid which contains 7 g of $H_2O_2$. The pulp treated in this manner is again filtered under suction, while still hot, over a frit and is rinsed with hot acetic acid.

| | |
|---|---|
| Kappa number: | 3.8 |
| Whiteness: | 39.5 ISO |
| Weight average degree of polymerization | 2467 |
| Breaking length | 13700 m (freeness 45 SR) |
| Bursting area: | 64.6 $m^2$ |
| Tear strength: | 57.3 cN |

(B) The procedure described in Paragraph A is repeated except that the pulp (270 g moist, 48.5 g absolutely dry) is treated with 1.75 g of $H_2O_2$ instead of 7 g of $H_2O_2$ and is gassed in the fluffed state in a rotating round-bottomed flask with ozone (10 liters, 3.5% of ozone in oxygen) at 20° C. for 1 hour. Thereafter, it is washed over a frit with hot acetic acid.

| | |
|---|---|
| Kappa number: | 0.27 |
| Whiteness: | 71.5 |
| Breaking length | 12260 m (freeness 70 SR) |
| Bursting area: | 65.2 $m^2$ |

By means of the ozone treatment, peroxide consumption can be dramatically reduced and a whiteness of more than 70% can still be obtained without deterioration of the mechanical properties. The fatty acid used for the process according to the invention can be worked up in a conventional and ecologically acceptable manner, for example by azeotropic distillation, and can be recirculated. The lignin-containing distillation residue can likewise be worked up in an ecologically acceptable manner, for example by combustion and heat recovery.

EXAMPLE 2

50 g of pulp prepared from pine chips (Pinus sylvestris, 45 years) by the acetosolve process (kappa number 24.2) are pressed out to a moisture content of 35% and then mechanically ground. The defibrated stock is introduced into a flask and treated with 1% to 3.3% of ozone (0.05 g of ozone/min, 0.06 g of ozone/liter of oxygen). After treatment for 10 to 40 minutes, the pulp is washed with acetic acid and then with water.

| | | | | | |
|---|---|---|---|---|---|
| Ozone (%, relative to the pulp) | 0 | 1.0 | 1.9 | 2.7 | 3.3 |
| Kappa number | 24.2 | 11.8 | 5.3 | 2.7 | 1.3 |
| Weight average degree of polymerization | 3420 | 3250 | 2990 | 2180 | 1660 |
| Paper properties (unbeaten) | | | | | |
| Freeness, SR | 19 | 21 | 23 | 26 | 29 |

-continued

| | | | | | |
|---|---|---|---|---|---|
| Breaking length, m | 8300 | 7060 | 7380 | 8250 | 8230 |
| Bursting area, $m^2$ | 58.8 | 51.2 | 55.0 | 56.3 | 57.5 |
| Tear strength, cN | 75.8 | 76.8 | 77.6 | 69.8 | 67.3 |

EXAMPLE 3

267.4 g of absolutely dry pine wood (Pinus sylvestris, 45 years) are digested by the acetosolve process. The pulp is treated with 2% of ozone as in Example 2 (first treatment stage) and washed with acetic acid. At a consistency of 12% of pulp in acetic acid, 1% of hydrogen peroxide is added and treatment is carried out for 6 hours at 70° C. (second treatment stage). The pulp obtained is washed with acetic acid, pressed out to a solids content of 35% and then treated with 0.6% of ozone (third treatment stage).

| | Treatment stage | | | | |
|---|---|---|---|---|---|
| | starting pulp | | 1. | 2. | 3. |
| Kappa number | 22.5 | | 4.2 | 1.5 | — |
| Whiteness, % ISO | 12 | | 30 | 40 | 60 |
| Yield, % | 50 | | 45.8 | 45.5 | 45.0 |
| Paper properties (unbeaten) | | | | | |
| Freeness | 19 | 30* | 26 | 27 | 30 |
| Breaking length, m | 7960 | 10150 | 9190 | 8930 | 9440 |
| Bursting area, $m^2$ | 46.9 | 63.3 | 53.2 | 57.1 | 56.6 |
| Tear strength, cN | 74.6 | 65.2 | 61.6 | 58.5 | 56.3 |

*8 min beating time in Jokro beater

Instead of the acetic acid used in Examples 1–3, it is also possible, as a rule, to use $C_{1-3}$-fatty acid mixtures, which are obtainable, for example, in the hydrolysis of vegetabilic wastes and consist of mixtures of acetic acid, propionic acid and formic acid.

EXAMPLE 4

Five 100 g samples of aceto-solve pulp from spruce were washed with 70%, 80%, 90%, 96% and 100% cold acetic acid, respectively, in a funnel. After suction and pressing with a glass stopper, the pulp contained 60% acetic acid (40% consistency). After washing with the cold acetic acid, the kappa number (26.5) of the pulp did not change. The five pulp cakes were removed and separately fluffed in a kitchen stirrer and then inserted into a 4 liter round-bottomed flask which was rotated. A stream of oxygen containing 2% ozone (based on pulp) was passed slowly (10 min at 20° C.) through the pulp in the flask. While the flask was rotated the outcoming stream of oxygen was bubbled through a solution of potassium iodide, to determine the residual ozone. After a total reaction time of 30 minutes, the pulp in the flask was removed to a suction funnel and again washed, first with acetic acid and then with water.

Determination of kappa numbers, brightness and $DP_W$ values were carried out according to German Standard Methods leading to the results shown in Table 1.

TABLE 1

Bleaching of spruce acetosolv pulp (kappa number 26.5) with 2% ozone
Influence of acetic acid concentration on kapa number, brightness and $DP_W$

| Concentration of acetic acid | Kappa number | Brightness (% ISO) | $DP_W$ |
|---|---|---|---|
| 70 | 12.6 | 17.4 | 2.340 |
| 80 | 8.2 | 24.8 | 2.430 |
| 90 | 7.0 | 27.6 | 2.730 |
| 96 | 5.8 | 27.3 | 2.950 |
| 100 | 5.0 | — | 3.150 |

From the aforementioned Example 4 it is seen that unexpected and improved results were obtained using acetic acid concentrations of 70% and above, while using the same amount of ozone (2%). As the concentration of acetic acid was increased up to 100% there was a continuous and significant decrease in the kappa number of the pulp (from 26.5 to 12.6 to 5.0). At the same time the brightness (degree of whiteness) and the degree of polymerization ($DP_W$) also increased. Thus, according to this invention, it is possible to obtain the delignification of pulp to low kappa numbers without significantly reducing the $DP_W$ values.

Although not wishing to be bound by any one particular theory, it is postulated that the unexpected and improved results obtained by the use of high concentrations of acetic acid (above 50%) may be due to: (1) suppressing the hydroxyl radicals that forms from ozone and water; and (2) providing a greater amount of ozone due to the increase of the solubility of ozone in concentrated acetic acid which is ten times higher than its solubility in water.

The unexpected and improved results obtained according to the present invention contrast favorably with the results obtained by investigators, Mbachu and Mauley, who in their prior art article "The Effect of Acetic and Formic Acid Pretreatment On Pulp Bleaching With Ozone" (TAPPI, Jan. 1981, Vol. 64, No. 1, pages 67–70), demonstrate that at a constant 2% or 3% ozone treatment, merely increasing the concentration of acetic acid from about 10% to about 45% does not yield any further improvement in the kappa value of the kraft pulp treated over that obtained using a 5% concentration of acidic acid. Id. at FIG. 2, page 68.

The present invention offers the additional advantage over the prior art process in that an alkali extraction step is not required due to the greater solubility of lignin degradation products in the higher concentration of acetic acid. By avoiding alkali extraction, the costly step of recovering the alkali and/or avoiding environmentality damaging effluents is also avoided.

Suitable modifications of the preferred embodiments discussed above can be made without departing from the inventive concepts disclosed herein and will be apparent to those experienced in the art. So, while certain embodiments of the invention have been explained in some detail, it is to be understood that the invention is not limited thereto but may be otherwise embodied and practiced within the scope of the following claims.

What is claimed is:

1. A method of bleaching a cellulosic pulp material containing a substantial amount of lignin for removal of said lignin from said cellulosic pulp material consisting essentially of the steps of: contacting said cellulose pulp material with a gaseous medium containing ozone in the presence of a liquid processing agent comprising an aqueous acetic acid solution having an acid content of at least 50% by weight, and causing an oxidative conversion of said lignin so as to increase the solubility of said lignin in said liquid processing agent and to improve said removal of said lignin from said cellulosic pulp material.

2. The method of claim 1 wherein water is present in an amount of less than 30% by weight of said liquid processing agent.

3. The method of claim 1 wherein said liquid processing agent comprises about 90% to about 98% by weight of acetic acid and about 2% to about 10% by weight of water.

4. The method of claim 1 wherein said contacting step is effected at a temperature below about 100° C.

5. The method of claim 1 wherein said contacting is effected at a temperature of below about 50° C.

6. The method of claim 1 wherein said contacting is effected at a temperature in the range of from about 0° C. to about 30° C.

7. The method of claim 1 wherein said gaseous medium contains at least about 100 ppm of said ozone.

8. The method of claim 1 wherein said gaseous medium contains said ozone at a concentration in the range of from about 1% to about 3% by weight of said gaseous phase.

9. The method of claim 8 wherein the concentration of ozone used is about 2%.

10. A method of producing a high grade pulp from a cellulosic material containing a substantial amount of lignin consisting essentially of the steps:

digesting said cellulosic material with an aqueous liquid comprising a major amount of acetic acid and obtaining a raw pulp which includes a residual amount of lignin;

solubilizing the residual lignin in said pulp in 50% or more acetic acid aqueous liquid mixture and from about 1% to about 3% gaseous ozone; and recovering said pulp as a substantially lignin-free pulp.

11. The method of claim 10 wherein said solubilized lignin is extracted from said pulp using acetic acid-containing aqueous liquid.

12. The method of claim 11 wherein the steps of digesting, solubilizing and extracting said lignin using acetic acid aqueous liquid is carried out counter-currently by first utilizing purified acetic acid aqueous liquid in the extracting step, and thereafter utilizing said aqueous liquid for the solubilizing and the digesting steps.

13. The method of claim 12 wherein the acetic acid aqueous liquid used in the digesting step is thereafter purified and again utilized in the extracting step.

14. The method of claim 10 wherein the concentration of acetic acid used is greater than 70%.

15. The method of claim 11 wherein the concentration of acetic acid used is greater than 70%.

16. The method of claim 12 wherein the concentration of acetic acid used is greater than 70%.

17. The method of claim 13 wherein the concentration of acetic acid used is greater than 70%.

18. The method of claim 10 wherein the concentration of acetic acid used is greater than 90%.

19. The method of claim 11 wherein the concentration of acetic acid used is greater than 90%.

20. The method of claim 12 wherein the concentration of acetic acid used is greater than 90%.

21. The method of claim 13 wherein the concentration of acetic acid used is greater than 90%.

22. The method of claim 10 wherein the recovered pulp has a kappa value of less than 5.

23. The method of claim 10 wherein the concentration of ozone used is about 2%.

24. The method of claim 11 wherein the concentration of ozone used is about 2%.

25. The method of claim 12 wherein the concentration of ozone used is about 2%.

26. The method of claim 13 wherein the concentration of ozone used is about 2%.

27. The method of claim 14 wherein the concentration of ozone used is about 2%.

28. The method of claim 15 wherein the concentration of ozone used is about 2%.

29. The method of claim 16 wherein the concentration of ozone used is about 2%.

30. The method of claim 17 wherein the concentration of ozone used is about 2%.

31. The method of claim 14 wherein the concentration of ozone used is about 2%.

32. The method of claim 15 wherein the concentration of ozone used is about 2%.

33. The method of claim 16 wherein the concentration of ozone used is about 2%.

34. The method of claim 17 wherein the concentration of ozone used is about 2%.

* * * * *